109-82 SR
12/29/87 XR 4,715,297

United States Patent [19]

Lichter

[11] Patent Number: 4,715,297

[45] Date of Patent: Dec. 29, 1987

[54] SAFE CONSTRUCTION AND REBAR COUPLING DEVICE FOR USE THEREWITH

[76] Inventor: Robert J. Lichter, 15571 Placid Cir., Huntington Beach, Calif. 92647

[21] Appl. No.: 834,205

[22] Filed: Feb. 27, 1986

[51] Int. Cl.[4] ..... E05G 1/00

[52] U.S. Cl. ..... 109/50; 52/169.7; 109/82; 403/305

[58] Field of Search ..... 52/169.7, 677, 726; 109/50, 51, 68, 80, 82, 84, 87; 403/305, 341, 396

[56] References Cited

U.S. PATENT DOCUMENTS

| | | | |
|---|---|---|---|
| 770,142 | 9/1904 | Wood | 109/50 |
| 3,031,801 | 5/1962 | Leuthesser | 52/169.7 |
| 3,036,407 | 11/1957 | Dixon | 52/677 |
| 3,610,288 | 10/1971 | Carr | 403/305 |
| 4,176,440 | 12/1979 | Lichter | 109/68 |

FOREIGN PATENT DOCUMENTS

| | | | |
|---|---|---|---|
| 291522 | 3/1968 | Australia | 109/50 |

*Primary Examiner*—Carl D. Friedman
*Assistant Examiner*—Caroline D. Dennison
*Attorney, Agent, or Firm*—Gausewitz, Carr & Rothenberg

[57] ABSTRACT

A safe construction having a liner configured for forming a valuables chamber with an access opening, the liner being positioned within a cavity in the ground with rebar assemblies adjustably connected to a framework secured to and supporting the liner within the cavity, the rebar assemblies each including first and second rebar sections with a rust resistant coupler interconnecting the two, the coupler being formed preferably of plastic with axially aligned but separated openings, each opening being configured for receiving an end of one of the rebar sections. The rebar assemblies are driven into the ground with the coupler at a position for being totally, or at least partially embedded in the poured concrete for deterring the formation of rust on the rebar sections within the concrete.

17 Claims, 3 Drawing Figures

SAFE CONSTRUCTION AND REBAR COUPLING DEVICE FOR USE THEREWITH

BACKGROUND OF THE INVENTION

The background of the invention will be discussed in two parts:

1. Field of the Invention

This invention relates to a safe construction which is formed-in-place reinforced concrete, and more particularly to a safe construction combined with a device for preventing rust in reinforcement members in poured concrete. Also, the invention relates to the device itself and to the combination thereof with concrete.

2. Description of the Prior Art

There are numerous prior art wall and floor safes adapted to be embedded in concrete, or adapted to be free-standing. Many of such safes are intended for residential use, and may be installed in a wall or in a floor of the residence, and, in the latter instance such safes are normally embedded in reinforced concrete. Floor safes typically, and for many years past, have been pre-constructed and placed in a position in the ground so that concrete could be poured thereabout as the floor slab was being poured during construction of the building.

A formed-in-place safe structure is shown and described in U.S. Pat. No. 4,176,440, issued to Robert J. Lichter, the applicant herein, on Dec. 4, 1979, such patent being entitled "Safe, and Method and Apparatus for Building It", the safe being a "do it yourself" safe having a liner with various grooves or slots adapted to receive the inner edge portions of steel bars of predetermined size, a bottom, a firecap mold, and a strong steel door with associated lock. The liner, with some of the parts, are assembled and positioned in a cavity in the ground at an appropriate location within the residence, with concrete reinforcing rods, or "rebars", positioned between the liner and the adjacent ground, after which the concrete is poured to form the slab along with the structural part of the walls of the safe, with the balance of the parts of the safe apparatus, such as the door and firecap, then being attached. The aforementioned patent is herein incorporated by reference.

In reinforced concrete construction, after erection of appropriate forms, reinforcing rods or rebars, made of an iron composition or steel, are placed in the area where the concrete is to be poured. For the pouring of concrete slabs, some rebar sections are positioned vertically by driving into the ground for supporting a framework of other horizontally extending rebar sections. In such construction, after the concrete has been poured and cured, moisture from the soil attacks the rebar sections at the point of contact with the ground or below ground level. Rusting of these portions occurs, which then migrates to the rebar sections on the interior of the concrete, thereby promoting a deterioration of the interior rebar sections with a resultant loss of structural integrity of the poured concrete.

It is accordingly an object of the present invention to provide a new and improved formed-in-place floor safe apparatus with reinforced concrete walls having provision for preventing rusting of rebar sections within the concrete.

It is another object of the present invention to provide a new and improved device for inhibiting the migration of rust to rebar sections on the interior of poured reinforced concrete construction.

It is yet another object of the present invention to provide a new and improved device for use with concrete reinforcing rods to preclude the migration of rust from the ground along the rebar to rebar sections embedded in the concrete interior of a formed in place safe structure.

It is still another object of the present invention to provide a new and improved method for reinforced concrete construction, and particularly to the preclusion of rust formation on the portion of the concrete reinforcing rods or rebars embedded in concrete.

SUMMARY OF THE INVENTION

The foregoing and other objects are accomplished by providing a safe construction including a coupler device formed of a non-rusting material, such as plastic, having a pair of aligned openings in opposing ends of the device for receiving first and second rebar sections, which collectively form a rebar assembly, with each rebar assembly supporting a corner of a safe liner assembly. One rebar section of the rebar assembly is driven into the ground until the device is above the dirt for embedding in concrete, along with the other rebar section.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

The safe construction to be hereinafter described is a floor safe and may be formed utilizing the construction heretofore described in applicant's U.S. Pat. No. 4,176,440, which is herein hereby incorporated by reference. The construction of the safe apparatus in such patent is an in place construction wherein a liner, preferably formed of an appropriate plastic material, is employed as a combination liner and form for the pouring of concrete thereabout to provide the majority of the body of the floor safe.

Figure 1:
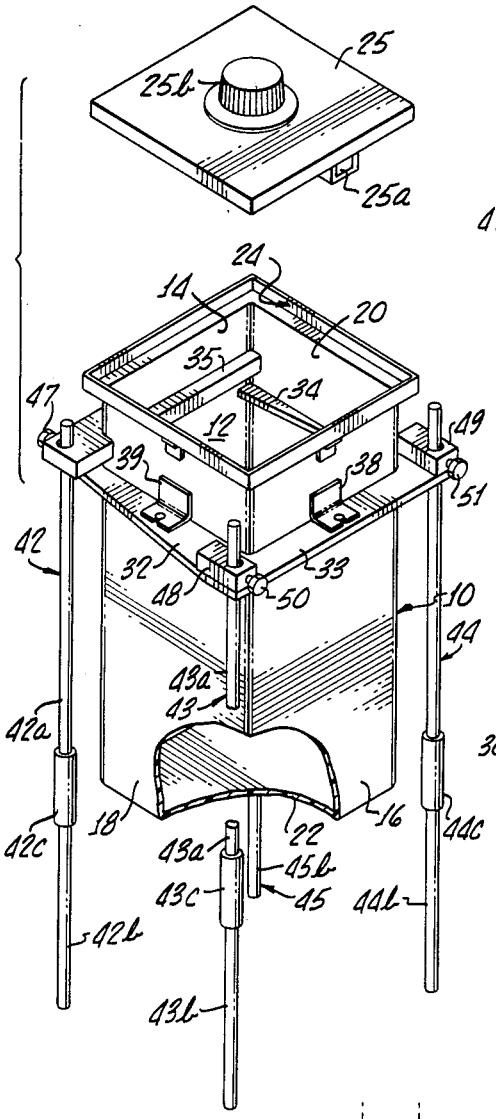
FIG. 1 is a perspective view of the components of the safe apparatus and rust proof concrete rebar coupler device in accordance with the present invention.

Referring now to the drawings, and particularly to FIG. 1, there is shown in perspective view a safe liner, generally designated 10, having a somewhat elongate generally rectangular (in plan view) form for defining a valuables chamber 12. The liner 10 is formed of a first set of opposing side walls 14 and 16, and an interconnecting set of mutually perpendicular opposing end walls 18 and 20. The bottom of the liner 10 is suitably closed with a floor portion 22, with the upper end of liner 10 defining an access opening 24 for receiving a separate door 25 therethrough.

Such a liner 10 may be made for example by injection molded plastics techniques, and may be fabricated from any suitable synthetic resin which provides sufficient rigidity for resisting deformation when the concrete is poured. It is also to be understood that the invention described herein is equally applicable to a safe which includes a liner formed of all metal, such as by steel fabrication or steel casting methods, which is then cast in place within the concrete. The invention also applies to an all-steel safe having no liner, but using thick walls instead.

Figure 2:
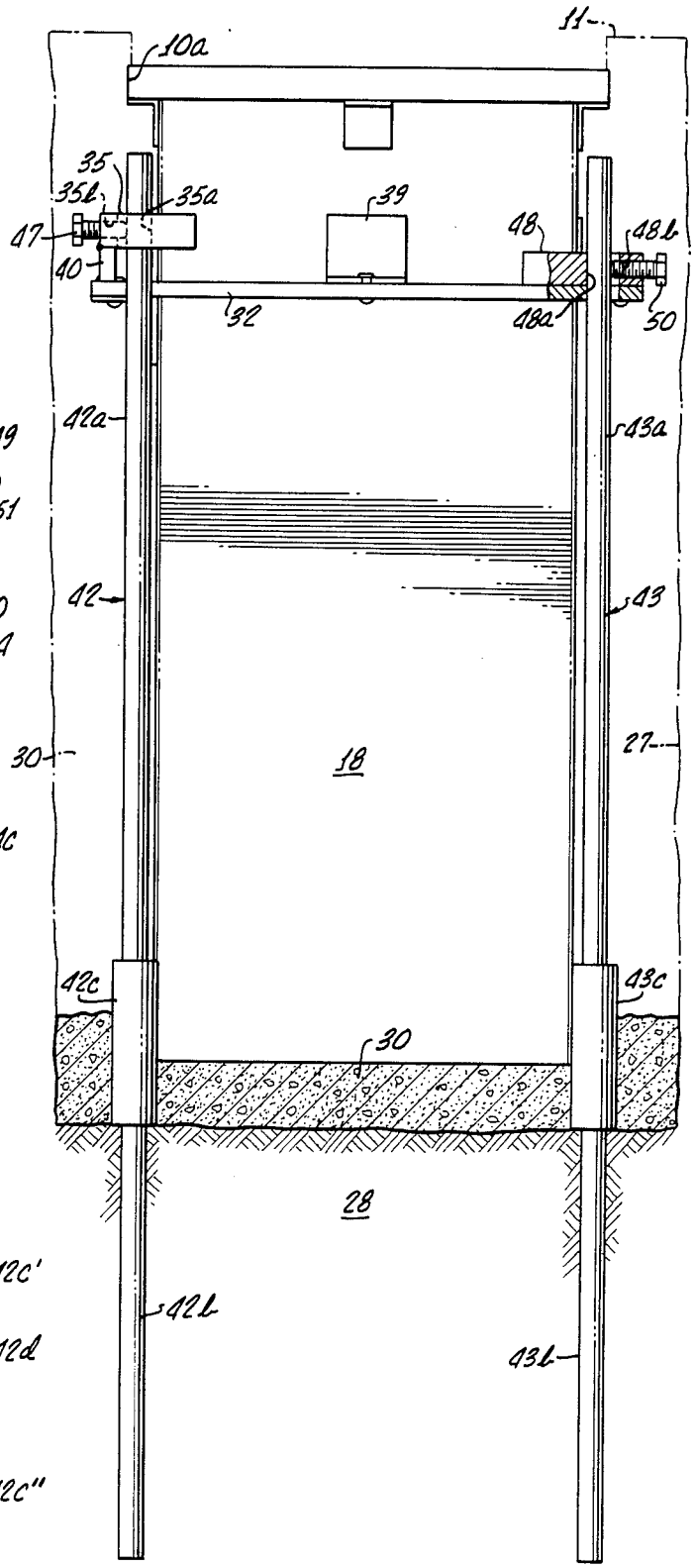
FIG. 2 is a side elevational view of the safe apparatus and rust proof concrete rebar coupler device of FIG. 1 illustrating the placement within the ground.

By reference also to FIG. 2, in accordance with the teachings of applicant's above-mentioned U.S. Pat. No. 4,176,440, the liner 10, is suitably positioned and supported within a cavity 27 formed in the ground 28, with the cavity 27 being dimensioned to provide a spacing of several inches from the four sides and bottom of the liner 10 for receiving concrete 30 therein. Normally, a two inch to four inch spacing will suffice, that is the dimensions of the cavity 27 will be four to eight inches wider than the dimension of the side walls 16 and 18, for example, and two to four inches below the floor 22 with the upper end of liner 10 recessed slightly below the proposed slab level (See FIG. 2). Although not necessary to an understanding of the invention, the liner 10 has the upper end thereof configured to provide an enlarged flange 10*a*, which is recessed below the level of the slab 11, with a removable wooden safe cover (not shown) positioned therein for concealing the safe. The upper surface of the safe cover is flush with the slab 11, and may have carpeting or other floor covering attached to the exposed surface thereof, consistent with the surrounding floor covering.

For enabling support of the liner 10 within the cavity 27, as well as providing a supporting structure for the door 25, a framework of bar members 32–35 is coupled to the liner, primarily on the exterior thereof, adjacent the upper part thereof. The bar members 32–35 are preferably formed of metal suitably connected together such as by bolts or by welding. As illustrated, the bar members 32, 33 and 34 are of generally uniform thickness, while bar member 35 is much thicker. Bar member 33 is secured to the exterior of side wall 16 by insertion into a slot formed therein, and then braced by a suitable angle brace 38, with the plane of bar member 33 in a direction generally perpendicular to the plane of the side wall 16. Bar members 32 and 34 are connected to opposing side walls 18 and 20 by means of aligned slots which extend a substantial portion of the side walls 18 and 20 in line with the slot within side wall 16, but not interconnected therewith. The bar members 32 and 34 have the first ends thereof connected to opposite ends of bar member 33, with the opposite ends thereof angularly positioned in converging relation toward side wall 14. Angle braces 39 (only one of which is shown) interconnect the bar members 32 and 33 to the respective sidewalls 18 and 20.

The bar member 35 is positioned by partial insertion into a slot formed within the side wall 14, the bar 35 being spaced upwardly a distance generally equal to the width of the door 25. By reference to FIG. 2, the bar member 35 is suitably secured relative to the bar members 32 and 34 by spacer members 40 (only one of which is shown) attached to each of the edges of bar members 32 and 33 and to opposite ends of the bar member 35, such as by welding.

The portions of the bar members 32, 33 and 34 extending into the interior of the chamber 12 form a ledge on which the door 25 rests, with one edge of the door 25 lying beneath the inwardly extending ledge of bar member 35. Each of the slots, and consequently each of the bar members 32–35 is positioned a predetermined distance below the plane of the flange 10*a* in generally parallel relation therewith. A suitable lock mechanism 25*a* on the underside of door 25 is operated by a combination dial 25*b* and has the bolt thereof received beneath the lower edge of bar member 33 for securing the door 25 in place. The door 25 is at a position below flange 10*a* sufficient for providing clearance for the combination dial 25*b* thereof with the wooden safe cover in place.

The framework formed from the bar members 32–35 is provided with means adjacent the four corners thereof for enabling connection thereto of four rebar assemblies generally designated 42–45. The connecting means include apertures through which the upper ends of the rebar assemblies are passed with bolt members engaging threaded orthogonal apertures in communication with the rebar receiving apertures.

By reference to FIG. 2, the opposite ends of the bar member 35 are provided with apertures, each having a diameter larger than the diameter of the upper end of the rebar assembly, such as aperture 35*a*, which extends in a line generally parallel to side wall 14. A second threaded aperture 35*b* extends along a line generally perpendicular to the line of the first aperture 35*a* for communication therewith. A threaded fastener member, such as bolt 47 passes through aperture 35*b* for securing the upper end of rebar assembly 42 to the framework. The opposite ends of bar member 33 likewise include connection means, which include a reinforcement bar portion 48 and 49, of thicker dimension, suitably attached, such as by welding, to opposite ends thereof. An aperture 48*a* extends through bar portion 48 and bar member 33 in a direction generally parallel to the plane of sidewall 16, with a second threaded aperture 48*b* in orthogonal relation thereto and in communication therewith. A suitable fastener member such as bolt 50 engages aperture 48*b* for tightening against rebar assembly 43 when inserted within aperture 48*a*.

The bar members 32–35, along with bar portions 48 and 49, are preferably formed of a steel composition, such as case-hardened steel, and have generally rectangular cross-sectional configurations, with the lengths thereof sufficiently longer than the corresponding side wall associated therewith to accomplish the interconnections required.

Figure 3:
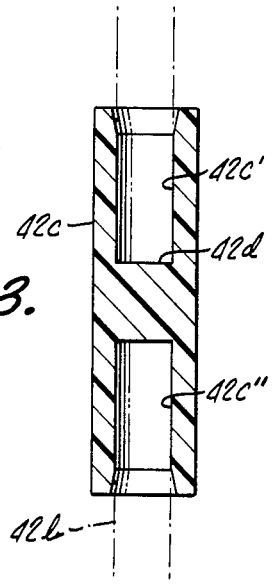
FIG. 3 is a cross-sectional view of the rust proof concrete rebar coupler device used in the apparatus of FIG. 1.

Each of the rebar assemblies 42–45 is formed of three parts, these being, by reference to rebar assembly 42, a first rebar section 42*a*, a second rebar section 42*b* and a rebar coupler 42*c*. The rebar sections 42*a* and 42*b* are formed of a metallic composition, such as an iron or steel composition, which is conventional for concrete reinforcing rods, or rebars. The rebar coupler 42*c* is formed of a high strength non-rusting material such as a plastic material. As shown in FIG. 3, the rebar coupler 42*c* is a generally elongate cylindrically configured member having an outer diameter greater than the outer diameter of the rebar sections 42*a* and 42*b*. Coaxial aligned cup-shaped openings 42*c*′ and 42*c*″ are formed therein, each extending partially into the interior thereof with a wall portion 42*d* therebetween, the diameter of openings 42*c*′ and 42*c*″ being generally equal to or slightly smaller than the diameter of the rebar sections 42*a* and 42*b* for enabling frictional retention of the rebar sections therein.

In use, each section 42*a* and 42*b* is cut or formed to the appropriate length or dimension, with an end of each then being inserted into the respective opening 42*c*′ and 42*c*″ of coupler 42*c*, such as by hammering, to thereby form a rebar assembly 42. The process is repeated with rebar assemblies 43–45, with the dimensions appropriately determined in accordance with the depth of the liner 10.

By reference to FIG. 2, the dimensions of the upper rebar sections 42*a* and 43*a* are such that, when the completed assembly is in place, the couplers 42*c* and 43*c* (along with couplers 44*c* and 45*c*) are just in contact with, or slightly below, the lower surface of the cavity 27 in the ground 28. In practice, this requires that the rebar assemblies 42–45 first be driven or hammered into the ground 28 prior to the placement of the liner 10 with the attached framework thereof into the cavity 27. For this purpose, a template, not shown, is provided, the template being in the form of a paper or cardboard having imprinted thereon, an outline of the cross-section of the liner 10 with cutouts, or holes, at the rebar assembly positions at the corners thereof. The template is then placed into the bottom of the cavity 27, generally centrally relative thereto. Each of the rebar assemblies 42–45, in turn, is driven or hammered into the ground through one of the template holes at the indicated locations.

The liner 10 along with the attached framework is then positioned into the cavity 27 with the upper ends of the rebar assemblies 42–45 passing through the apertures 35*a*, 48*a*, etc. in the four corners of the framework, whereupon the bolt members, such as bolt members 47, 50, 51 are tightened at the position where the flange portion 10*a* of liner 10 is at the proper distance below the intended level of slab 11.

Upon pouring of the concrete 30, each of the rebar couplers 42*c*–45*c* is contained partially, or substantially within the concrete, with each of the upper rebar sections 42*a*–45*a* confined completely within the concrete 30, thus precluding migration of any rust formation from the lower rebar sections 42*b*–45*b* in the ground 28 to the upper rebar sections 42*a*–45*a* in the concrete 30. The rebar couplers 42*c*–45*c* thus act as barriers to rust formation in the rebars within the concrete 30 which assists in maintaining the structural integrity of the safe.

In accordance with the present invention, the rebar assemblies 42–45 serve multiple purposes. The first is as a support for adjustably vertically positioning the liner 10 within the cavity 27. Secondly, the assemblies serve the conventional purpose of concrete reinforcement, while the plastic couplers 42*c*–45*c* additionally serve as rust proof barriers for precluding destructive rust formation on the rebar sections 42*a*–45*a* within the concrete. In addition, when the assemblies 42–45 are assembled prior to insertion, the couplers 42*c*–45*c* serve as stops for driving the assemblies 42–45 into the ground.

Although the use of the rebar couplers 42*c*–45*c* has been described for use with a safe construction, such rebar assemblies, utilizing such couplers, have utility in other reinforced concrete applications as a means for preventing the migration of rust formation from the ground through reinforcing members. For example, the rebar couplers and associated rebar support elements can be used to support electrical conduit around which the concrete is poured. While there has been shown and described a preferred embodiment, it is to be understood that various other adaptations and modifications may be made within the spirit and scope of the invention.

I claim:

1. A safe construction comprising:

safe-wall means forming a valuables receiving chamber and being configured for pouring of concrete thereabout;

connector means attached to said safe-wall means;

a plurality of rebar assemblies attached to said connector means, each of said rebar assemblies including at least one rebar section having one end thereof attached to said connector means and the other end thereof attached to a coupler device, each of said coupler devices being formed of a non-rusting material, each of said coupler devices being positionable relative to the ground with said coupler device in a position for at least partial embedment in the poured concrete along with said at least one rebar section of said rebar assemblies, said coupler device acting as a barrier to the formation of rust on said at least one rebar section.

2. The combination according to claim 1 wherein each of said rebar assemblies includes first and second rebar sections attached to said coupler device in general alignment, and said coupler device is a member having first and second separated openings, each opening receiving one end of one rebar section.

3. The combination according to claim 2 wherein said coupler device is formed of a plastic material, and in which said coupler device is elongate, and in which said openings are generally coaxial.

4. The combination according to claim 1 wherein said connector means comprises framework means which extend at least partially into the interior of said safe-wall means for supporting a door member.

5. The combination according to claim 4 wherein said framework means include a plurality of bar members, and said safe-wall means is a liner that includes means for retaining said bar members with said bar members extending at least partially into the interior of said liner.

6. The combination according to claim 5 wherein said retaining means includes slot means.

7. The combination according to claim 4 wherein said framework means includes apertures for receiving therein the upper ends of the rebar sections of said rebar assemblies and means for frictionally retaining said upper ends therein.

8. The combination according to claim 7 wherein said frictional retaining means includes bolt means extending into said aperture means.

9. The combination according to claim 1, in which concrete is provided and embeds said coupler devices and associated at least one rebar sections and safe-wall means and connector means.

10. In a floor safe construction for onsite assembly in a cavity in the ground, the combination comprising:

a liner having a first set of opposing walls and a second set of mutually perpendicular walls defining, at least in part, a valuables receiving chamber with an access opening thereto, said liner being adapted for placing in a cavity in the ground for receiving concrete thereabout;

framework means attached to said liner at least partially on the exterior thereof, with portions thereof extending into the interior for supporting a door;

rebar assembly means attachable to said framework means on the exterior of said liner, each of said rebar assembly means including first and second rebar sections interconnected in axial alignment with a coupler device therebetween formed of a nonrusting material for enabling the positioning of one of said rebar sections of each of said rebar assembly means into the ground with said coupler device in a position for at least partially embedding said coupler device in the poured concrete along with all of the other of said rebar sections, said coupler device acting as a barrier to the formation of rust on said other rebar section.

11. The combination according to claim 10 wherein said coupler device is a generally cylindrical member having first and second coaxially aligned but separated openings.

12. The combination according to claim 11 wherein said coupler device is formed of a plastic material.

13. The combination according to claim 10 wherein said framework means include a plurality of bar members and said liner includes means for retaining said bar members with said bar members extending at least partially into the interior of said liner.

14. The combination according to claim 13 wherein said retaining means includes slot means.

15. The combination according to claim 14 wherein said bar members are elongate steel bars of generally rectangular cross-section adapted, dimensioned and positioned for embedding in the concrete upon pouring.

16. A method of constructing a safe in a cavity in the ground, which comprises:

(a) providing a liner adapted to have concrete poured on the exterior thereof and adapted to receive valuables on the interior thereof, and having an access opening;

(b) providing a high strength framework on said liner with a portion of said framework extending into the interior of said liner for supporting a door member, and a portion of said framework extending outwardly from said liner and adapted to be embedded in concrete; and (c) supporting said liner within said cavity by a plurality of rebar assemblies attached to said framework on the exterior of said liner, each of said rebar assemblies including first and second rebar sections interconnected in axial alignment with a coupler device formed of a non-rusting material for enabling the driving of one of said rebar sections of each of said rebar assemblies into the ground with said coupler device in a position for at least partially embedding said coupler device in the poured concrete along with all of the other of said rebar sections, said coupler device acting as a barrier to the formation of rust on said other rebar section.

17. The method according to claim 16 wherein said coupler device includes a cylindrical member having coaxial aligned cupshaped openings therein, each opening being configured for receiving therein one end of a rebar section.

* * * * *